US008596229B2

(12) United States Patent
Shin

(10) Patent No.: US 8,596,229 B2
(45) Date of Patent: Dec. 3, 2013

(54) VENTILATION HEAD COVER OF ENGINE

(75) Inventor: Bosung Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 201 days.

(21) Appl. No.: 13/173,673

(22) Filed: Jun. 30, 2011

(65) Prior Publication Data

US 2012/0145118 A1 Jun. 14, 2012

(30) Foreign Application Priority Data

Dec. 8, 2010 (KR) ..... 10-2010-0124948

(51) Int. Cl.
*F01M 13/00* (2006.01)
*F02B 25/06* (2006.01)

(52) U.S. Cl.
USPC ..... 123/41.86; 123/572

(58) Field of Classification Search
USPC ..... 123/572–574
See application file for complete search history.

(56) References Cited

U.S. PATENT DOCUMENTS

| | | | | |
|---|---|---|---|---|
| 4,627,406 | A * | 12/1986 | Namiki et al. | 123/573 |
| 5,005,553 | A * | 4/1991 | Washizu et al. | 123/572 |
| 6,412,478 | B1 * | 7/2002 | Ruehlow et al. | 123/572 |
| 7,165,541 | B2 * | 1/2007 | Hommes | 123/572 |
| 7,631,639 | B2 * | 12/2009 | Yonebayashi et al. | 123/572 |
| 2005/0092267 | A1 * | 5/2005 | Nonaka et al. | 123/41.86 |
| 2007/0295315 | A1 * | 12/2007 | Guerry et al. | 123/572 |

FOREIGN PATENT DOCUMENTS

| | | | |
|---|---|---|---|
| JP | 6-18645 | U | 3/1994 |
| JP | 2003-301710 | A | 10/2003 |
| KR | 2002-0045619 | A | 6/2002 |
| KR | 10-2007-0064518 | A | 6/2007 |

* cited by examiner

*Primary Examiner* — Lindsay Low
*Assistant Examiner* — Syed O Hasan
(74) *Attorney, Agent, or Firm* — Morgan, Lewis & Bockius LLP

(57) ABSTRACT

A ventilation head cover of an engine may include a head cover main body having a blow-by exhaust portion, a baffle plate disposed in the head cover main body with a predetermined distance from the head cover main body to form a gas passage with the blow-by exhaust portion, and an oil inflow prevention wall formed to an end portion of the baffle plate and engaged with the head cover main body, wherein the oil inflow prevention wall includes at least a gas passage hole to form the gas passage.

12 Claims, 2 Drawing Sheets

VENTILATION HEAD COVER OF ENGINE

CROSS-REFERENCE TO RELATED APPLICATION

The present application claims priority to Korean Patent Application No. 10-2010-0124948 filed in the Korean Intellectual Property Office on Dec. 8, 2010, the entire contents of which is incorporated herein for all purposes by this reference.

BACKGROUND OF THE INVENTION

1. Field of the Invention

The present invention relates to a ventilation head cover. More particularly, the present invention relates to a head cover covering a cylinder of an engine.

2. Description of Related Art

An engine of a vehicle includes a cylinder block and a cylinder head cover. A blow-by gas is formed by a compression stroke and an expansion stroke of the engine. The blow-by gas flows into a cylinder block through a gap between the cylinder and a piston. And, the interior of the cylinder block has a high pressure by the blow-by gas. Accordingly, if the blow gas flowing into the cylinder block is not exhausted, the engine can stop its operating or be exploded.

Thus, an internal combustion engine needs a ventilation system that circulates the blow-by gas generated by the operation thereof to exhaust it to an outside. And, the ventilation system is applied to a head cover covering the cylinder of the engine.

However, there is a problem that oil together with the blow-by gas is exhausted in a process of exhausting the blow-by gas through the head cover having the ventilation function while a crank and cam are rotating.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a ventilation head cover for an engine having advantages of effectively suppressing oil together with blow-by gas from being exhausted.

A ventilation head cover of an engine according an exemplary embodiment of the present invention may include a head cover main body having a blow-by exhaust portion, and a baffle plate that may be engaged with the head cover main body to form a gas passage, wherein the plate main body and one side end portion of the plate main body may be bent to form an oil inflow prevention walls in the baffle plate and a plurality of gas passage holes may be formed therein.

One of the gas passage holes formed in one of the oil inflow prevention walls may not face one of the gas passage holes formed in the other of the oil inflow prevention walls.

A size of the gas passage holes of the oil inflow prevention wall may be different from that of the gas passage holes of the neighboring oil inflow prevention wall.

The oil inflow prevention walls may be bent in a direction crossing with the plate main body.

The gas passage may be formed between the head cover main body and the baffle plate.

The oil inflow prevention walls may be disposed at an inlet of the gas passage.

A blow-by gas that may be formed in the engine may flow into the gas passage holes that may be formed in the oil inflow prevention walls to be exhausted through the gas passage and a blow-by outlet.

The ventilation head cover for an engine in an aspect of the present invention can effectively suppress the oil together with the blow-by gas from being exhausted.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
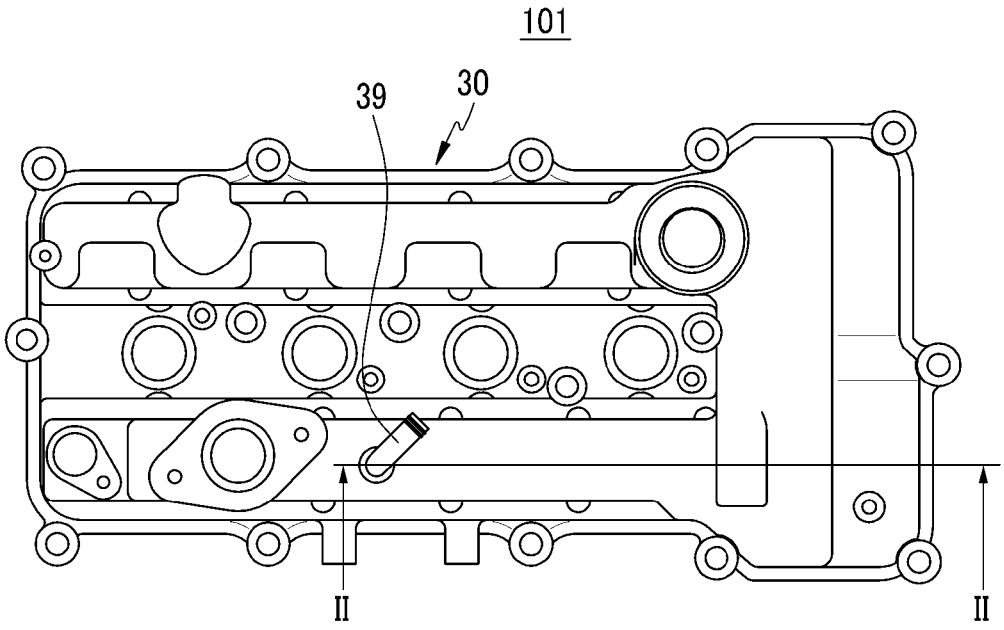
FIG. 1 is a top plan view of a ventilation head cover for an engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Also, like reference numerals designate like elements throughout the specification.

Further, because a size and a thickness of each element that is displayed in the drawings are randomly displayed for better understanding and ease of description, the present invention is not limited thereto.

Hereinafter, referring to FIG. 1 to FIG. 3, a ventilation head cover for an engine 101 according to an exemplary embodiment of the present invention will be described.

Figure 2:
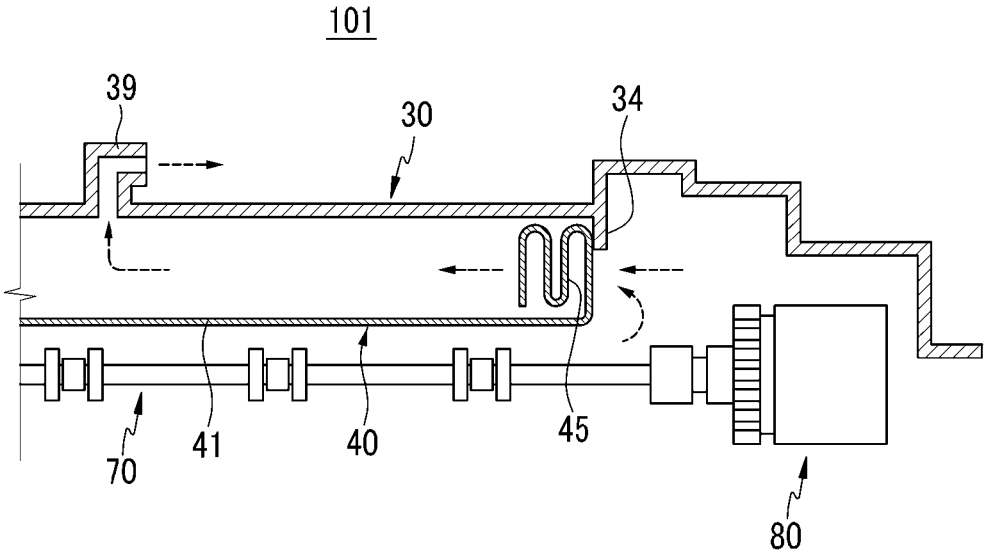
FIG. 2 is a cross-sectional view along a line II-II of FIG. 1.

As shown in FIG. 1 and FIG. 2, a ventilation head cover for an engine 101 includes a head cover main body 30 and a baffle plate 40.

The head cover main body 30 includes a blow-by exhaust portion 39 and a mounting portion 34. The blow-by exhaust portion 39 exhausts a blow-by gas that is generated from the interior of the engine to the outside of the engine. The mounting portion 34 combines the head cover main body 3 with the baffle plate 40.

The baffle plate 40 combines with the head cover main body 30 to form a gas passage. In other words, the baffle plate 40 and the head cover main body 30 are combined with each other to form a space as a gas passage. The baffle plate 40 includes a plate main body 41 forming a gas passage and oil inflow prevention walls 45 disposed at an inlet of the gas passage. Here, as shown in FIG. 3, a plurality of oil inflow prevention walls 45 respectively have a plurality of gas passage holes 459

A plurality of oil inflow prevention walls 45 are made by bending one side end portion of the plate main body 41 several times. In this case, a plurality of oil inflow prevention walls 45 can be bent in a direction that crosses the plate main body 41. That is, a plurality of oil inflow prevention walls 45*a*, 45*b*, 45*c* and 45*d* are made by bending one side end of the plate main body 41 several times to be wrinkled.

Generally, a camshaft 70, and a crankshaft and a timing device 80 are disposed under the ventilation head cover for an engine 101. That is, the ventilation head cover for an engine 101 is disposed to cover the camshaft 70, and the crankshaft and the timing device 80.

The blow-by gas generated at a compression stroke and an expansion stroke, while the engine operates, passes the gas passage holes 459 formed in the oil inflow prevention walls 45 and the gas passage formed between the head cover main body 30 and the baffle plate 40 to be exhausted to the outside of the engine through the blow-by outlet 39 of the head cover main body 31.

In this process, the oil inflow prevention walls 45 prevents the oil scattered by the camshaft 70 and the crankshaft from being exhausted to the outside together with the exhaust gas.

Figure 3:
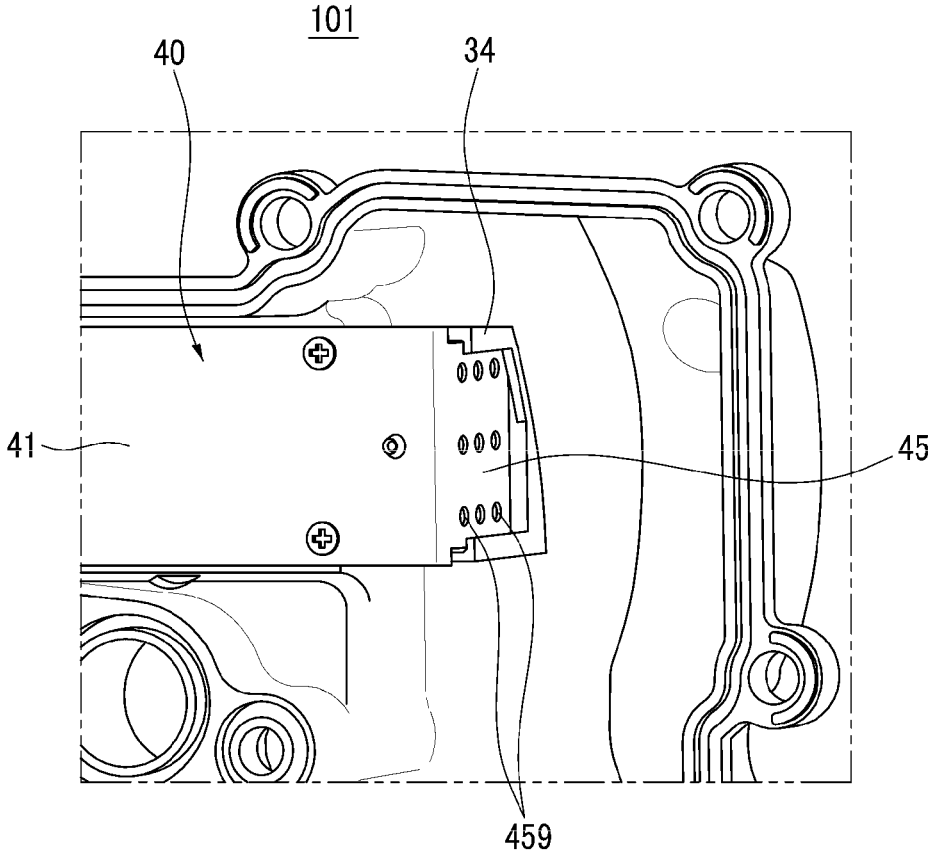
FIG. 3 is a perspective view of a baffle plate used for a ventilation head cover for an engine of FIG. 1.

Also, as shown in FIG. 3, the gas passage holes 459 that are formed in one of the oil inflow prevention walls 45 of the baffle plate 40 according to an exemplary embodiment of the present invention does not face the gas passage holes 459 of the neighboring oil inflow prevention wall 45. Also, size of the gas passage holes 459 can be different from that of the gas passage holes 459 that are formed in the neighboring oil inflow prevention wall 45.

In a process that the blow-by gas passes the gas passage holes 459 formed in the oil inflow prevention walls 45, the oil included in the blow-by gas can be effectively separated therefrom.

Figure 4:
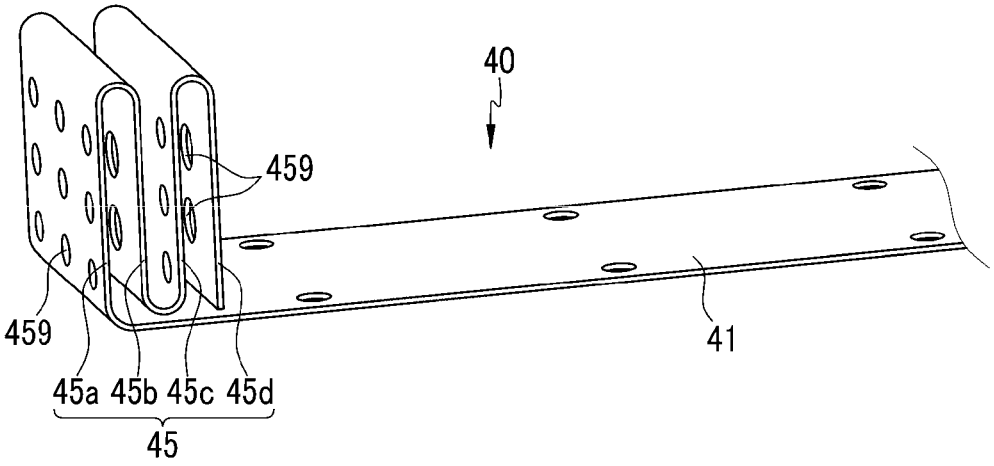
FIG. 4 is a partial bottom perspective view of a ventilation head cover of an engine of FIG. 1.

Meanwhile, as shown in FIG. 4, the oil inflow prevention wall 45 of the baffle plate 40 is inserted into the mounting portion 34 of the head cover main body 30 to be engaged thereto. Also, the plate main body 41 of the baffle plate 40 can be combined with the head cover main body 30 through a screw.

A ventilation head cover for an engine 101 according to an exemplary embodiment of the present invention can effectively prevent the oil from being exhausted together with the blow-by gas.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A ventilation head cover of an engine comprising:

a head cover main body having a blow-by exhaust portion; and a baffle plate disposed at a lower side of the head cover main body with a predetermined distance therebetween to form a gas passage with the blow-by exhaust portion, wherein the baffle plate, including a plate main body having one side end portion of the plate main body, integrally bent several times alternating in upward and downward directions to form a plurality of oil inflow prevention walls;

wherein the plurality of oil inflow prevention walls include:

a first oil inflow prevention wall bent from the one side end portion of the plate main body vertically in the upward direction;

a second inflow prevention wall bent from an upper end of the first oil inflow prevention wall vertically in the downward direction;

a third inflow prevention wall bent from a lower end of the second oil inflow prevention wall vertically in the upward direction; and a fourth inflow prevention wall bent from an upper end of the third oil inflow prevention wall vertically in the downward direction;

wherein each of the first, second, third and fourth oil inflow prevention walls comprises a plurality of gas passage holes formed therein.

2. The ventilation head cover of claim 1, wherein the gas passage is formed between the head cover main body and the baffle plate.

3. The ventilation head cover of claim 2, wherein the oil inflow prevention walls are disposed at an inlet of the gas passage.

4. The ventilation head cover of claim 1, wherein one of the gas passage holes that are formed in one oil inflow prevention wall in the plurality of the oil inflow prevention walls does not face one of the gas passage holes that are formed in a neighboring oil inflow prevention wall in the plurality of the oil inflow prevention walls.

5. The ventilation head cover of claim 4, wherein the gas passage is formed between the head cover main body and the baffle plate.

6. The ventilation head cover of claim 5, wherein the oil inflow prevention walls are disposed at an inlet of the gas passage.

7. The ventilation head cover of claim 4, wherein the gas passage is formed between the head cover main body and the baffle plate.

8. The ventilation head cover of claim 7, wherein the oil inflow prevention walls are disposed at an inlet of the gas passage.

9. The ventilation head cover of claim 1, wherein the oil inflow prevention walls are bent in a direction crossing with the plate main body.

10. The ventilation head cover of claim 9, wherein the gas passage is formed between the head cover main body and the baffle plate.

11. The ventilation head cover of claim 10, wherein the oil inflow prevention walls are disposed at an inlet of the gas passage.

12. The ventilation head cover of claim 1, wherein a blow-by gas that is formed in the engine flows into the gas passage holes that are formed in the oil inflow prevention walls to be exhausted through the gas passage and a blow-by outlet of the blow-by exhaust portion.

* * * * *